US007712265B2

(12) United States Patent
Overmyer, Jr. et al.

(10) Patent No.: US 7,712,265 B2
(45) Date of Patent: May 11, 2010

(54) SPECIAL CEMENT-LIKE COATED MOBILE BUILDING AND PROCESS TO MANUFACTURE

(76) Inventors: Douglas Overmyer, Jr., 407 S. Walnut, Ridgeville, IN (US) 47380; Russell Matthew Wilber, 401 N. Portland St., Ridgeville, IN (US) 47380

( * ) Notice: Subject to any disclaimer, the term of this patent is extended or adjusted under 35 U.S.C. 154(b) by 783 days.

(21) Appl. No.: 11/496,926

(22) Filed: Aug. 1, 2006

(65) Prior Publication Data

US 2007/0266649 A1 Nov. 22, 2007

Related U.S. Application Data

(60) Provisional application No. 60/802,473, filed on May 22, 2006.

(51) Int. Cl.
*E04B 1/34* (2006.01)

(52) U.S. Cl. ..... 52/143; 52/309.7; 52/309.16; 52/454

(58) Field of Classification Search ..... 52/309.17, 52/309.12, 309.9, 309.7, 454, 444, 446, 741.41, 52/747.1, 747.12, 309.16, 270, 143, 223.7, 52/79.12, 424, 426
See application file for complete search history.

(56) References Cited

U.S. PATENT DOCUMENTS 1,955,818 A * 4/1934 Marshall ..... 52/236.9
2,396,828 A * 3/1946 Carpenter ..... 52/92.3
3,992,844 A * 11/1976 Gretter ..... 52/426
4,052,829 A * 10/1977 Chapman ..... 52/281
4,077,170 A * 3/1978 van der Lely ..... 52/79.1
4,287,241 A * 9/1981 Kaufmann ..... 427/403
4,620,404 A * 11/1986 Rizk ..... 52/602
4,645,374 A 2/1987 Erickson et al.
4,649,677 A * 3/1987 Oldham ..... 52/90.1
4,691,490 A * 9/1987 Leaver ..... 52/293.3
4,723,381 A * 2/1988 Straumsnes ..... 52/79.12
4,774,794 A * 10/1988 Grieb ..... 52/309.7
4,841,705 A * 6/1989 Fuhrer ..... 52/410
4,858,398 A 8/1989 Ricchini
4,961,297 A * 10/1990 Bernard ..... 52/93.1
5,136,822 A * 8/1992 Blum ..... 52/241
5,172,532 A 12/1992 Gibbar, Jr.
5,218,792 A 6/1993 Cooper
5,398,468 A 3/1995 Erickson
5,404,685 A * 4/1995 Collins ..... 52/309.7
5,471,804 A 12/1995 Winter, IV
5,524,400 A 6/1996 Schmechel
5,584,151 A 12/1996 Abou-Rached (Continued)

*Primary Examiner*—Basil Katcheves
*Assistant Examiner*—Joshua Ihezie
(74) *Attorney, Agent, or Firm*—John D. Ritchison

(57) ABSTRACT

A special high durability, building device and process to construct same. This device is essentially comprised of a base or chassis, an expanded polystyrene foam, structural members (of various materials and shapes) inside the foam and a cementitious material sprayed on the exterior of the foam. The configuration is such that the walls, floor, and roof are rigidly attached to each other yet maintain good flexural strength to resist wind loads and temperature changes. The system is anticipated for mobile and manufactured homes as well as other residential and commercial use. The construction of buildings has the cementitious coating to most surfaces and the structure uses minimal or no non-durable materials such as wood, nails, and screws. This provides resistance to surface damage to walls, rot, and decay.

12 Claims, 11 Drawing Sheets

U.S. PATENT DOCUMENTS 5,758,463 A 6/1998 Mancini, Jr.
5,809,726 A * 9/1998 Spude ..... 52/426
5,852,907 A * 12/1998 Tobin et al. ..... 52/714
5,930,964 A * 8/1999 Boehning ..... 52/309.1
5,950,397 A * 9/1999 Ginn et al. ..... 52/742.14
5,953,875 A * 9/1999 Harkins ..... 52/407.3
6,058,672 A * 5/2000 McClellan ..... 52/587.1
6,101,779 A * 8/2000 Davenport ..... 52/602
6,164,035 A * 12/2000 Roberts ..... 52/563
6,167,671 B1 * 1/2001 Wilson ..... 52/654.1
6,185,891 B1 * 2/2001 Moore ..... 52/309.7
6,256,960 B1 * 7/2001 Babcock et al. ..... 52/592.1
6,298,619 B1 * 10/2001 Davie ..... 52/293.3
6,405,509 B1 * 6/2002 Razl ..... 52/800.12
6,412,243 B1 * 7/2002 Sutelan ..... 52/309.7
6,460,302 B1 * 10/2002 Neuhaus et al. ..... 52/261
6,519,904 B1 * 2/2003 Phillips ..... 52/309.12
6,647,686 B2 * 11/2003 Dunn et al. ..... 52/426
6,698,710 B1 * 3/2004 VanderWerf ..... 249/216
6,735,917 B1 5/2004 Notermann
2001/0011443 A1 * 8/2001 Watanabe et al. ..... 52/506.05
2003/0029108 A1 * 2/2003 Neuhaus et al. ..... 52/309.12
2003/0167716 A1 * 9/2003 Messenger et al. ..... 52/309.12
2005/0050821 A1 * 3/2005 Brugeaud et al. ..... 52/309.17

* cited by examiner

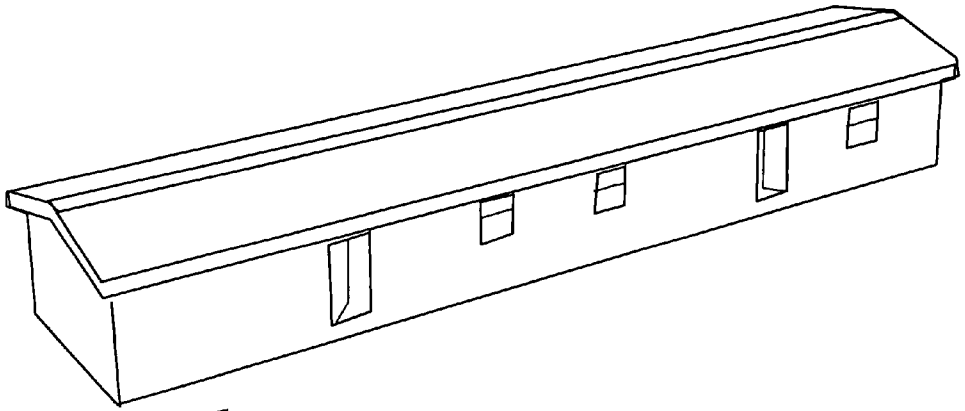
Fig. 1 B
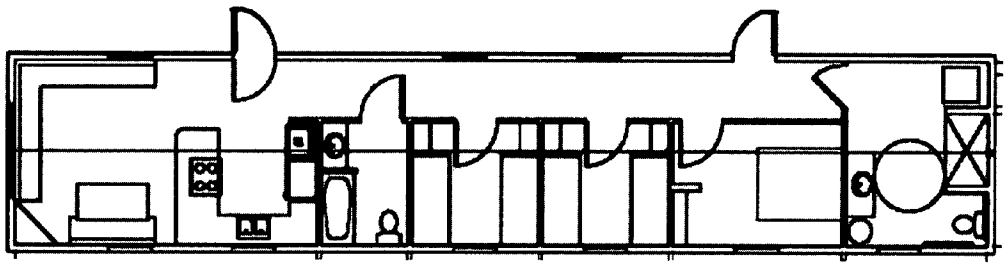
Fig. 1 C
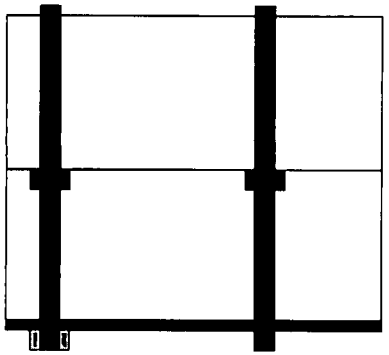
Fig. 1 A
Fig. 1

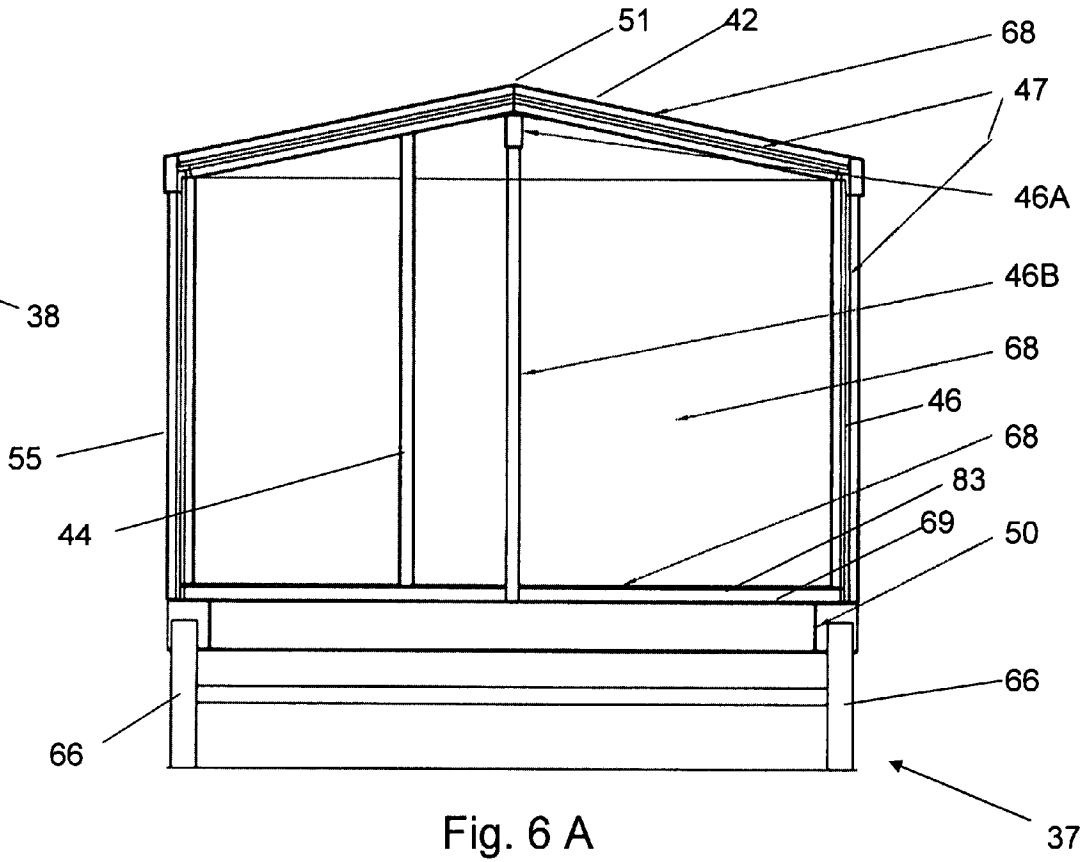
Fig. 6 A
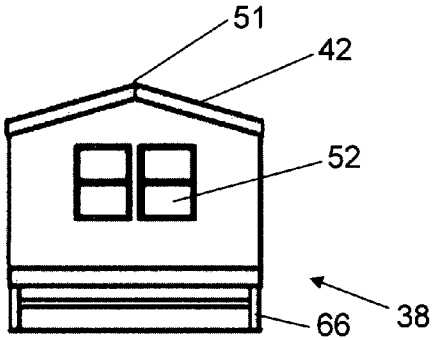
Fig. 6 B
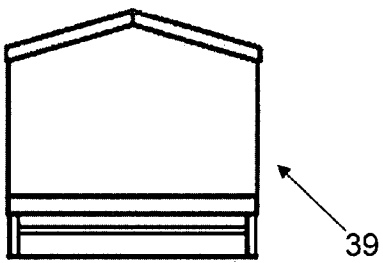
Fig. 6 C
Fig. 6

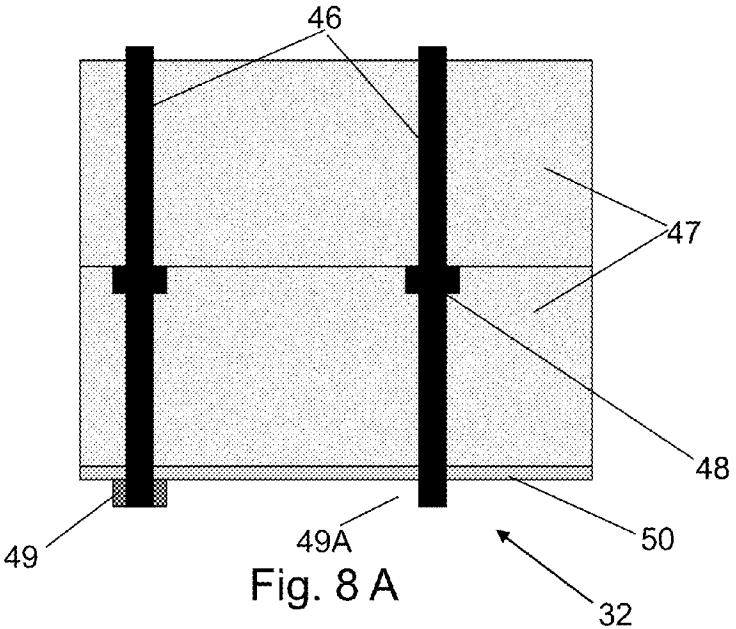
Fig. 8 A
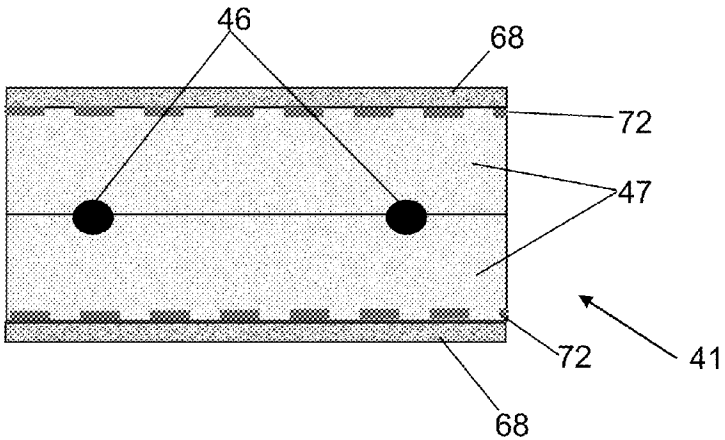
Fig. 8 B
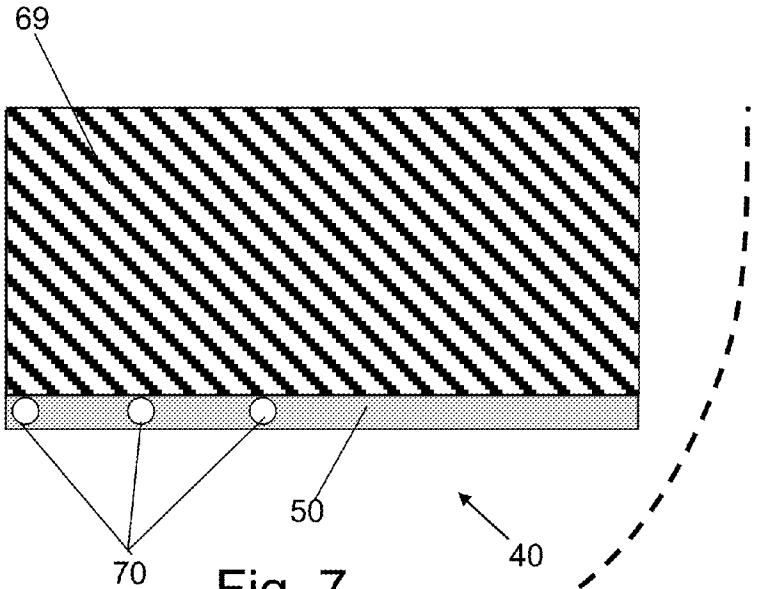
Fig. 7
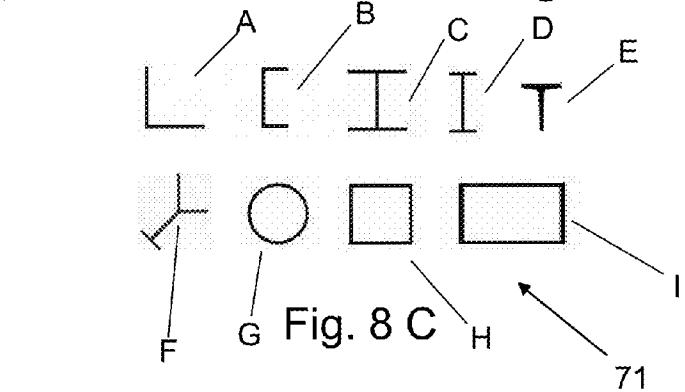
Fig. 8
Fig. 8 C 78
42B 76
42

77
76
42A 47
45
75
71F 82
82

82

46
50
82
69

47
72
68
46
74
69
44
72
68
68
47
68

46
46A
46B
73
68
68
72
47
72
43
68
72
47
69
72
68

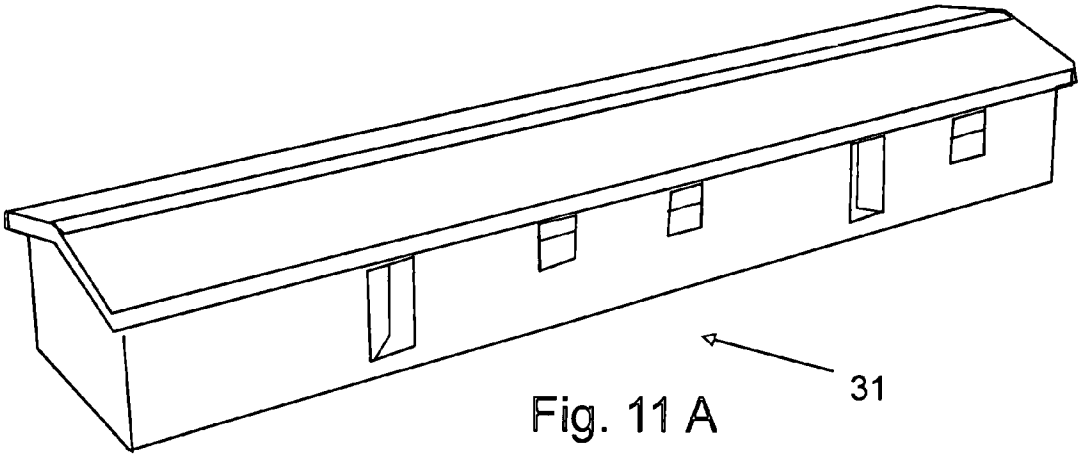
Fig. 11 A
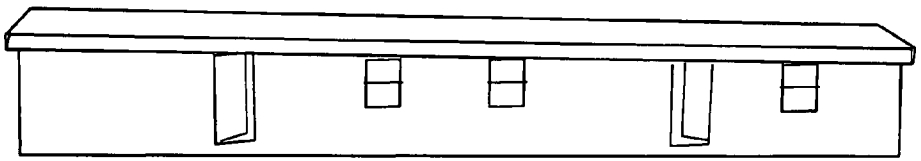
Fig. 11 B
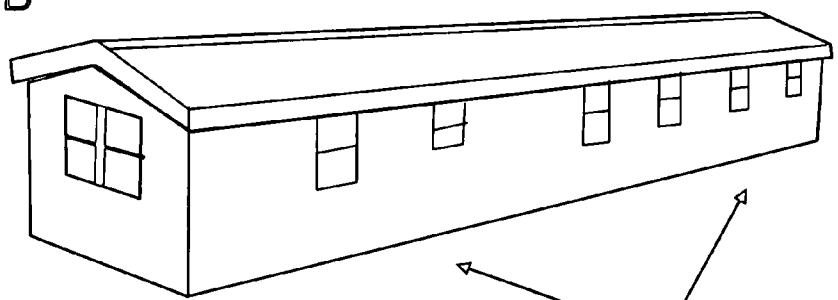
Fig. 11 C
Fig. 11

SPECIAL CEMENT-LIKE COATED MOBILE BUILDING AND PROCESS TO MANUFACTURE

CROSS-REFERENCE TO RELATED APPLICATIONS

This application claims the benefit of Provisional Patent Application Ser. No. 60/802,473 filed May 22, 2006 by Douglas Overmyer, Jr. and Russell Matthew Wilber and titled "Special Cement-like Coated Mobile Building and Process to Manufacture".

FIELD OF INVENTION

This invention relates to buildings, especially mobile homes and the process to construct the building. Particularly, this device is a special high durability building that has no materials subject to rotting or decay. This is achieved with available products combined in a new manner with specific process steps that will be demonstrated below.

FEDERALLY SPONSORED RESEARCH: Not Applicable at this time although HUD and FEMA are aware of this new invention.

SEQUENCE LISTING OR PROGRAM: Not Applicable.

BACKGROUND

Field of Invention and Prior Art

The new Special Cement-like Coated Mobile Building device and Process to Manufacture described in this specification is a building device and method that is designed to easily and quickly provide a durable and economical alternative to current manufactured and mobile homes.

A. Introduction of the Problems Addressed

The concept of an improved shelter gained momentum with the vision of such a concept in terms of disaster shelters currently available to victims, responders and evacuees. This feature is important for disaster relief and has the attention of HUD and FEMA for use in disaster relief. As will be explained in detail below, this Cement-like Coated Mobile Building and the process to construct uses available materials to answer the need for durable, lower cost construction in many areas.

B. Prior Art

Historically, manufactured and mobile homes have been built with wood, metal and other materials. The natural materials such as wood have been susceptible to rot and decay with time and the presence of moisture and temperature variations. Likewise, the surface materials of the walls, ceilings and some roofs have not been resilient or durable enough to withstand exposure to high use and the natural elements. The maintenance to keep these types of buildings in good condition has been excessive, especially when exposed to migrant tenants with short rent and lease occupancy. Several attempts to improve the building system have been made, but with little success. In use, the prior art devices were often complex, difficult to install and limited in improving durability. The new Special Cement-like Coated Mobile Building device and Process to Manufacture addresses these limitations and provides a solution to the stated problems.

Examples of some prior building systems with panels and the like begin with U.S. Pat. No. 4,645,374 issued to Erickson, et al (1987). This teaches a plurality of upright panels and a top with a connector to secure the objects. The use of center structures with the foam and cementitious coatings as utilized with the innovative Special Cement-like Coated Mobile Building device and Process to Manufacture is not mentioned or anticipated. Another U.S. Pat. No. 4,691,490 issued to Leaver (1987) presents an earthquake useful design that incorporates Cementitious materials in panels that are connected with complex flanges and fasteners. The modular panel and panel assembly have upstanding edges that form flanges to orient and contain part of the panel. The complex system relies on self supporting and individual resistance by each successive panel.

Another U.S. Pat. No. 4,841,705 issued to Fuhrer (1989) provides a building wall covering system for application to a wall support such as masonry block. The system comprises a layer of insulative material and an overlying layer of matting which is attached to the wall support structure. The idea claims to provide some structural strength by the matting to the cementitious coating material applied thereto. In the U.S. Pat. No. 4,858,398 issued to Ricchini (1989), a prefabricated construction system is taught. The modular building construction system uses rectangular wall and roof panels and triangular gable panels. The panels are secured together with simple fasteners inserted through aligned openings in adjacent edges of the panels and turned to lock them in place. No cementitious coating or interior and exterior coating is taught. Individual panel are taught unlike the series of contiguous core material as in the Special Cement-like Coated Mobile Building device.

Other prior art includes the U.S. Pat. No. 5,172,532 issued to Gibbar, Jr. (1992). This is another prefabricated polymer and concrete building wall panel which teaches generally a section of polystyrene, as a slab, which is sculpted to form grooves by hot wire cutting or other cutting means, and into which reinforcement rods may be located. This is in preparation for the pouring or pumping of concrete therein, to form a concrete built skeletal structure for reinforcing the panel. The panels are erected into a building wall structure. Insulative materials may be applied over the open grooved side either before or after concrete is poured therein. The grooves cut into the polystyrene panel may be a design shaped for enhanced reinforcement to strengthen the panels. A mobile home building system is featured in U.S. Pat. No. 5,218,792 issued to Cooper (1993). The mobile housing structure is provided having a pair of side walls with vertical support posts extending upward from a chassis and connecting to an elongated side wall honeycomb configuration. A modular roof section is formed of a sandwich construction with Styrofoam block members adhesively connected to panels. The roof joint members can be riveted to the side joint members. There is no mention of cementitious coatings, plastic-like structural members, or contiguous Styrofoam that forms a running wall. Surface durability appears less an objective than weight of the overall design configuration.

In U.S. Pat. No. 5,398,468 issued to Erickson (1995), a panel and connector assembly building system is taught. The system is comparatively complex to the Special Cement-like Coated Mobile Building device. Erickson teaches a series of upright panels, joined together with vertical connectors and horizontal inserts. Adjacent edges of the panels have complimentary beveled faces and aligned grooves. Special configuration of the connectors and special flanges cooperate with the panel configurations to hold the panels in a structural engagement. Another building system of prefabricated panels is demonstrated by U.S. Pat. No. 5,471,804 issued to Winter, IV (1995). The system uses prefabricated building panels with a foam core. The fastening components and raceway components used with the panels are essentially placed during the prefabrication. The method for the assembling of a building incorporates locking mechanisms integrated with a raceway system. This system connects wall panels together in edge-to-edge relationship to form walls. Further complexity is shown with the ram-lock and cam-lock devices. No description or anticipation of cementitious coating for strength or surface durability is taught.

In U.S. Pat. No. 5,524,400 issued to Schmechel (1996) a wall assembly is shown. The wall assembly utilizes a plurality of panels having preformed grooves and supports which interface with these grooves. Supports are positioned within the various grooves of each of the panels and are interconnected. These panels are made from Styrofoam and the supports are generally U-shaped, steel studs. Several panels may be positioned adjacent to each other to provide the structure. Surface coating to strengthen the overall structure is not addressed nor is mobility mentioned. The overall system is complex as compared to the Special Cement-like Coated Mobile Building device. Another building structure is taught in U.S. Pat. No. 5,584,151 issued to Abou-Rached (1996). The system is a very complex structure for earthquake, wind and fire resistance devised of pre-fabricated framed building panels. The frame members are connected together at the perimeter of the panels. There are series of fasteners and connector plus configured voids which may ultimately form a web of steel and concrete when the entire sections are cast with a substance. The connections absorb and distribute seismic forces to the entire structure and some frame members act to absorb residual seismic forces reaching the individual panels.

In the U.S. Pat. No. 5,758,463 issued to Mancini, Jr. (1998) a composite modular building panel is shown and taught. These are fully pre-cast panels, not structures of Styrofoam built in place and then coated. The modular building panel is a single, monolithic, planar slab formed primarily of cellular concrete and having a pair of parallel linear members. The slab extends between the webs of the linear members. It does not teach the complete structure for a mobile building nor does it teach exterior and interior coating for strength.

Next in U.S. Pat. No. 5,953,875 issued to Harkins (1999), a slide-in building insulation system is taught. There are shown a set of slide tracks secured to the wall and roof system. The insulative material is then held in place. This has insulative properties but is considerably unlike the Special Cement-like Coated Mobile Building device. There is no continuous building process anticipated. In the U.S. Pat. No. 6,735,917 issued to Notermann (2004), a connected frame structure and method of connecting frame members is taught. The interlocking joint structure has a tubular frame member with a key-shaped slot to slidably accommodate a second elongated T-shaped frame member. An adhesive is used to bond the first and second frame members together. The system anticipates sectional panel to interlock and shows no anticipation as to a cementitious coating to add strength to the overall structure and durability to the surface.

As far as known, there are no housing or building products or processes at the present time which fully meet this need with as few of components and superior operation as the present Special Cement-like Coated Mobile Building device and Process to Manufacture. It is believed that this device is made with fewer parts, of a more durable design, and with much less expense than any previous mobile housing or building device. The overall combination and configuration is not demonstrated or anticipated by other patents on their face.

SUMMARY OF THE INVENTION

A Special Cement-like Coated Mobile Building device and Process to Manufacture has been developed for use to create durable buildings not subject to normal decay and rotting. The new Special Cement-like Coated Mobile Building permits the construction of mobile homes and other buildings with minimal or no use of non-durable materials such as wood, nails, screws and others. Specifically, the preferred embodiment of the Special Cement-like Coated Mobile Building device is essentially comprised of a base or chassis, an expanded poly styrene foam, structural members (of various materials and shapes) inside the foam and a cement based material sprayed on the exterior of the foam. The configuration is such that the walls, floor, and roof are rigidly attached to each other yet maintain good flexural strength to resist wind loads and temperature changes. The materials are easily processed to provide many other optional features within the normal course of constructing a mobile home and other buildings. The floor plans for a traditionally built mobile home or other building are easily achieved with lower costs and higher strength and durability as explained in detail below.

The new use of a process is to spray a cementitious polymer-based material onto a substrate of expanded polystyrene foam walls, flooring, interior, and roof structures. The process yields a durable, reusable design that is easily deployed and made livable for as long as may be necessary.

The newly invented Special Cement-like Coated Mobile Building device features very few parts and may be built quickly in the process described below. In operation, the new Special Cement-like Coated Mobile Building device may be easily transported to wherever it is needed and quickly attached to existing utilities or special emergency systems as required.

Shelters are designed with an exterior and interior that is coated with a concrete based substance. These surfaces will withstand severe punishment without need of repair or repaint. The walls of the shelters are formed with no wood or other material that may decay or rot while being used. The resilience and properties of the interior wall, floor and ceiling surfaces will provide a unit that will be reusable when faced with only normal wear and tear. This surface will also allow for ease of cleaning and a quick turn-around time for people in need.

Objects and Advantages

There are several objects and advantages of the Special Cement-like Coated Mobile Building device and Process to Manufacture. There are currently no known building devices or processes that are effective at providing the objects of this invention.

One advantage and object of the present invention is that it is very durable. The cement based material that is sprayed and troweled on the entire exterior resists moisture, humidity, mold and abnormal wear and tear. Abnormal wear and tear is often seen in areas of temporary, housing for disaster relief. The occupants do not own the building and sometimes do not care as much for the building as one they will be in permanently. This ability to withstand severe punishment reduces the need of repair or repaint of the units before re-use. This durable unit, therefore may be re-used for disaster relief.

Another advantage is that the Special Cement-like Coated Mobile Building resists shocks, fire, wind, and other natural or un-natural calamities. The whole structure is securely connected through the cement-like coating on exterior and interior surfaces of the walls, floor and roof. This structural shell creates a very strong building unit to withstand much environmental abuse from nature.

A further advantage is that it is less labor intensive to build, uses simple processes to manufacture, uses fewer parts, and uses common, non-natural materials. Therefore the process and resulting device is less expensive.

A somewhat hidden advantage is that it is lighter when finished. The foam, while strong with the outer cementitious material, is lighter than the normal wood and sheet metal. This lighter unit means there is a less expensive transportation cost.

Finally, other advantages and additional features of the present Special Cement-like Coated Mobile Building and Process to Manufacture device will be more apparent from the accompanying drawings and from the full description of the device. For one skilled in the art of building devices and processes to manufacture, it is readily understood that the features shown in the examples with this mechanism are readily adapted to other types of building devices and processes.

DESCRIPTION OF THE DRAWINGS—FIGURES

The accompanying drawings, which are incorporated in and constitute a part of this specification, illustrate an embodiment of the Special Cement-like Coated Mobile Building and Process to Manufacture that is preferred. The drawings together with the summary description given above and a detailed description given below serve to explain the principles of the Special Cement-like Coated Mobile Building and Process to Manufacture. It is understood, however, that the Special Cement-like Coated Mobile Building and Process to Manufacture is not limited to only the precise arrangements and instrumentalities shown.

FIG. 1 is a depiction of the general device. FIG. 1A is a sketch of the general wall section, FIG. 1B is a drawing of the model, and FIG. 1C is a layout of the floor plan for a Cement-like Coated Mobile Building.

Figure 5:
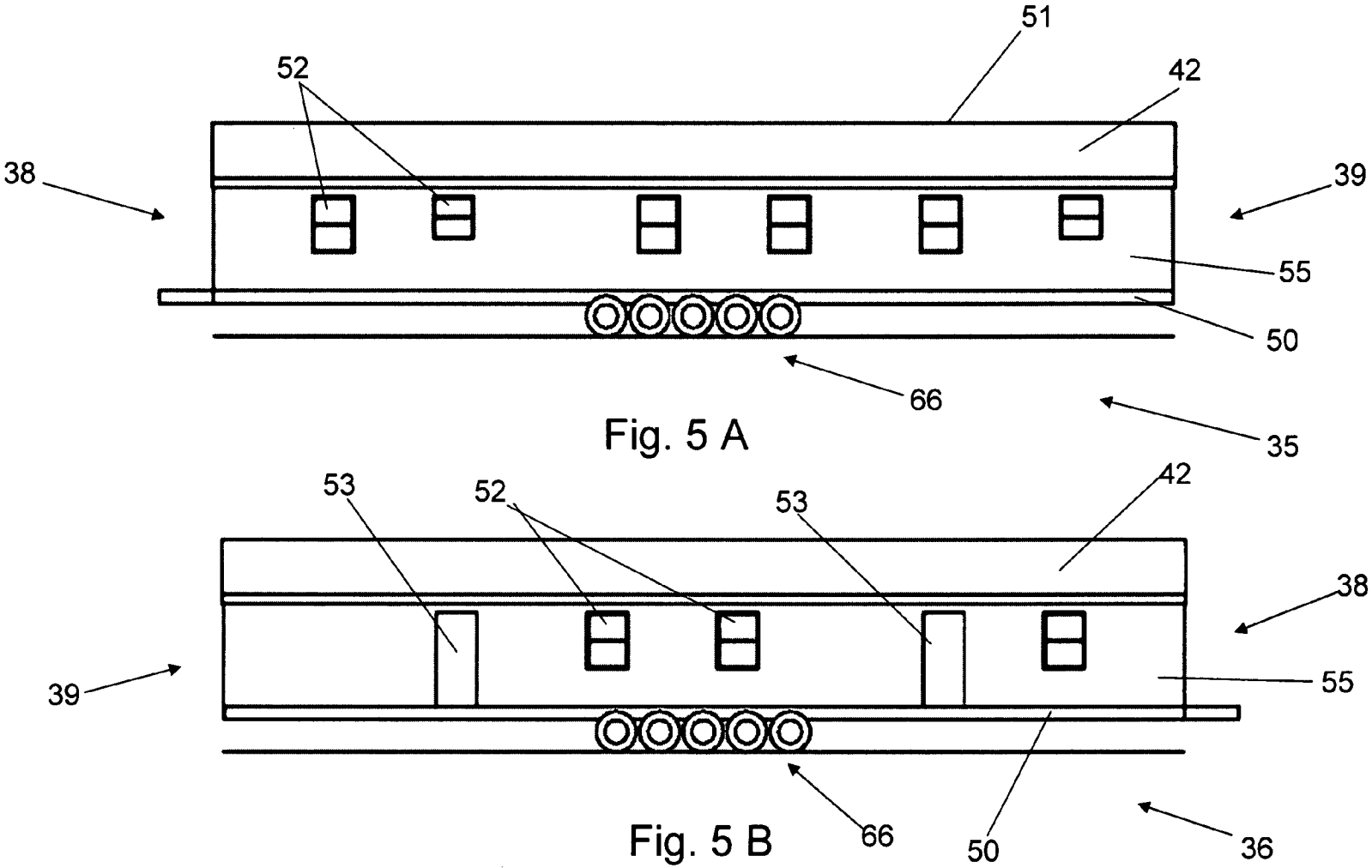

FIGS. 5A and B are elevations of the Cement-like Coated Mobile Building device with features noted.

FIGS. 6A through 6C are the End view and a section of the Cement-like Coated Mobile Building with additional components identified.

FIG. 7 is a top view of the base or chassis upon which the Cement-like Coated Mobile Building is built.

FIGS. 8A through 8C are the wall sections with components identified.

Figures 9, 9A, 9B, 9C, 10, 10A, 10B, 10C, 10D, 10E, 10F:
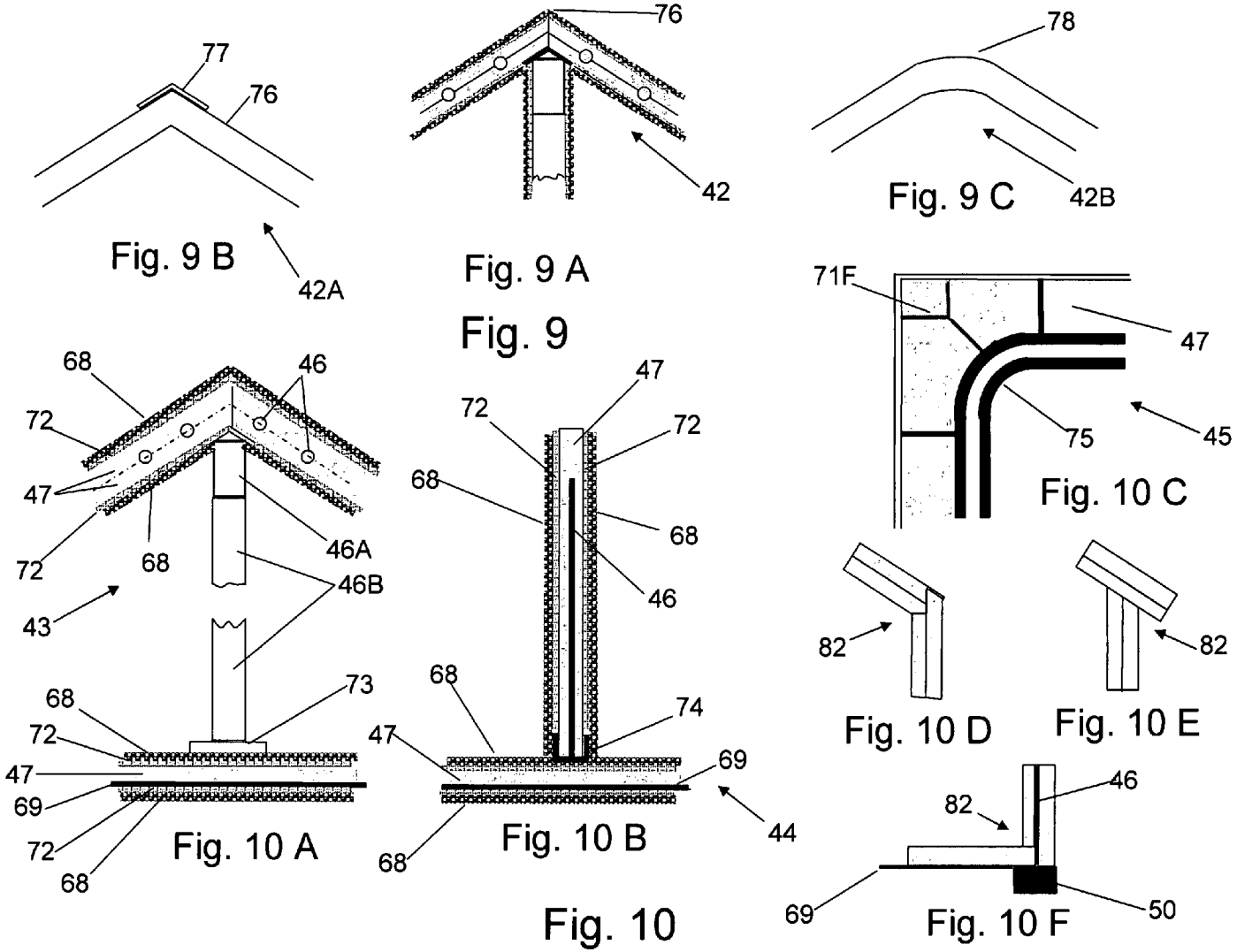

FIGS. 9A through 9C are some examples of roof peak optional embodiments for the Cement-like Coated Mobile Building.

FIGS. 10A through 10F are wall elevations and sections that show various components of the Cement-like Coated Mobile Building.

FIGS. 11A through 11C are drawings of the model Cement-like Coated Mobile Building from various angles.

Figure 12:
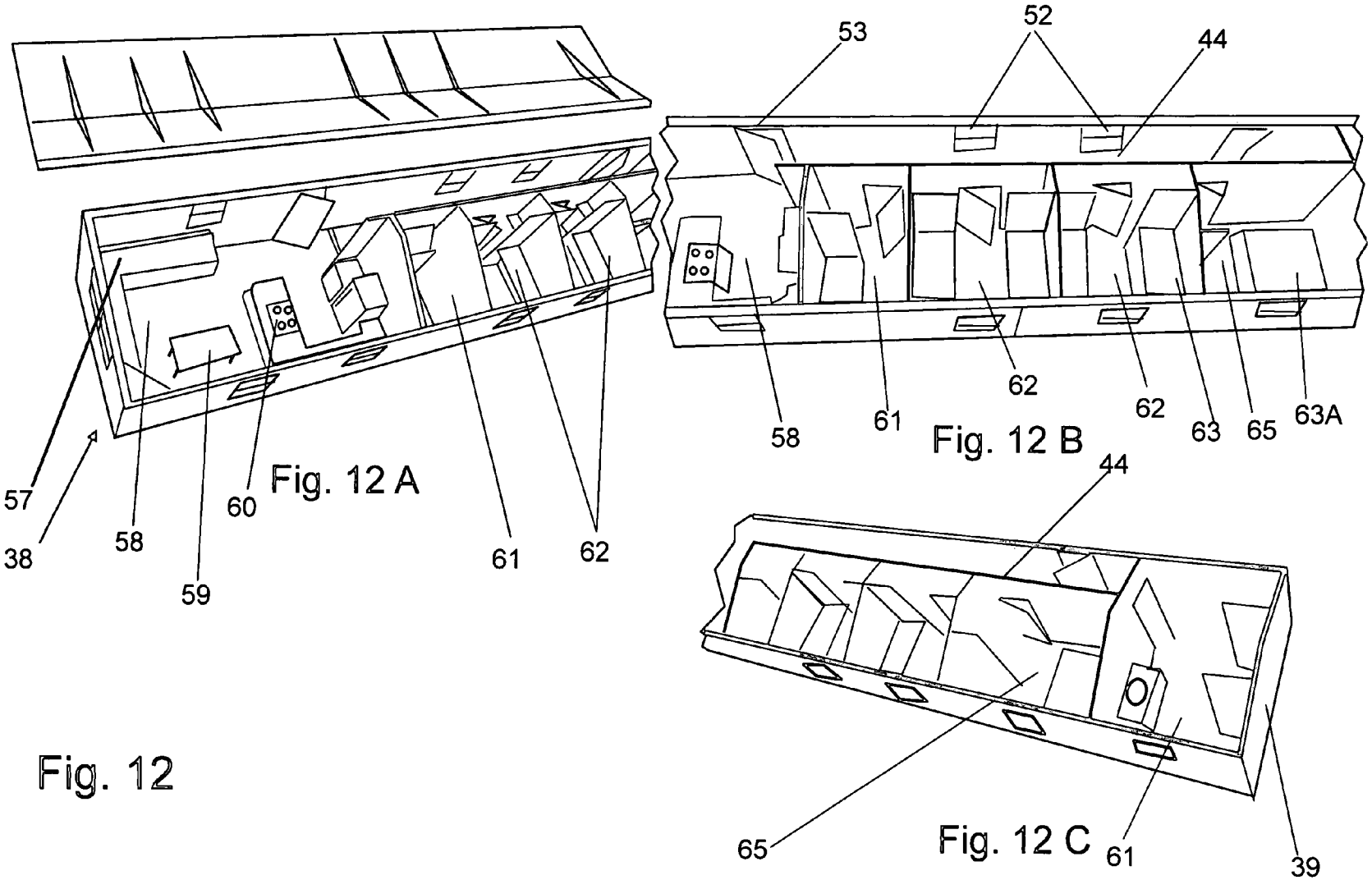

FIGS. 12A through 12C are drawings of the model Cement-like Coated Mobile Building with the roof section removed. These drawings permit many of the components for the Cement-like Coated Mobile Building to be demonstrated.

Figure 13:
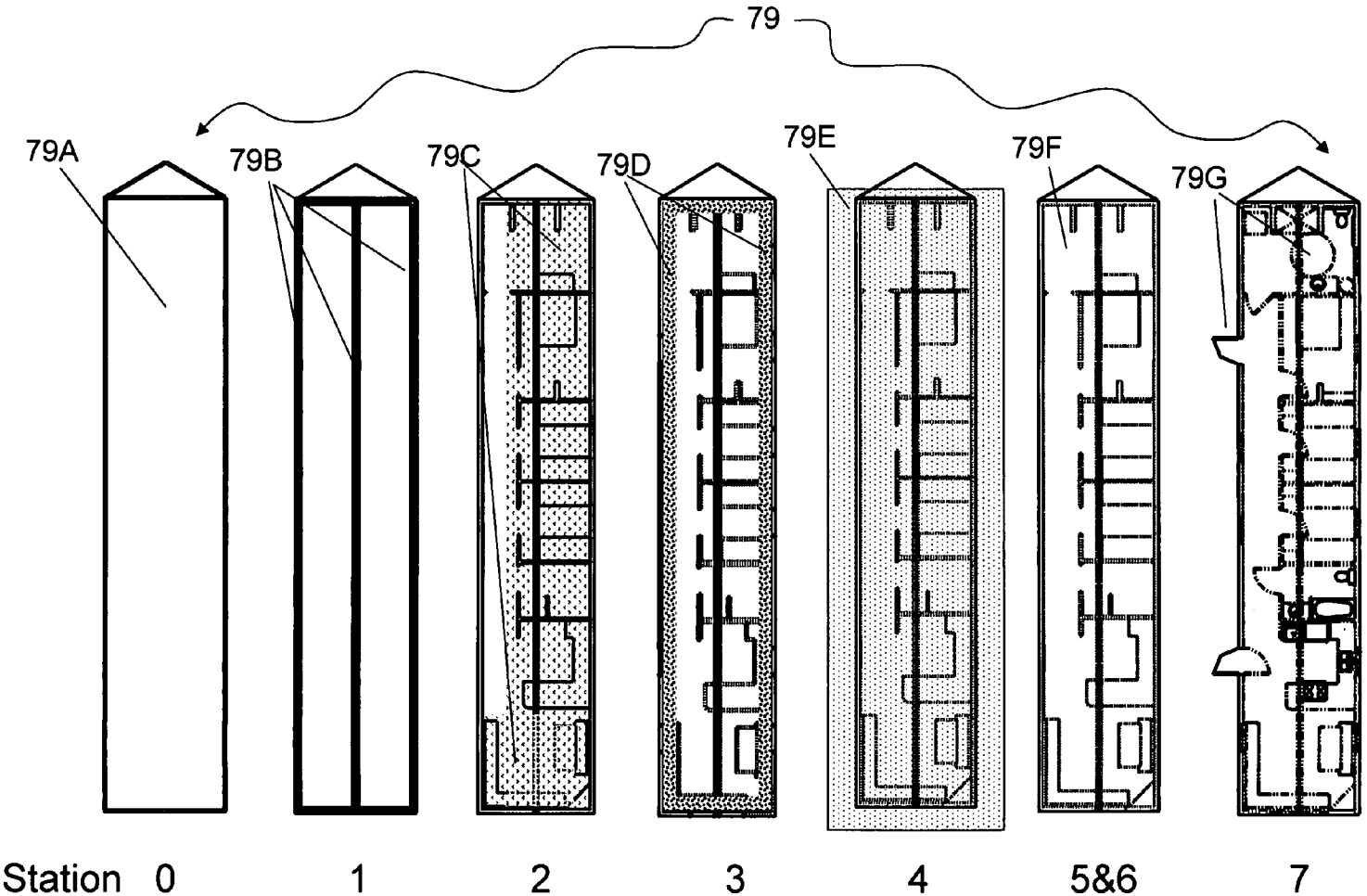

FIG. 13 is a summary of the process and sketches for the stations used to build the Cement-like Coated Mobile Building.

DESCRIPTION OF THE DRAWINGS—REFERENCE NUMERALS

The following list refers to the drawings:

31 general model of the device—Cement-like Coated Mobile Building (device)
32 side view of a general wall for the device
33 floor plan for a device
34 general architectural plans for the device
35 rear side elevation
36 front/entry side elevation
37 section view
38 kitchen/trailer tongue end view
39 opposite kitchen end view
40 top view of chassis/base
41 cross section of typical wall section
42 roof section with out any peak cover (preferred)
42A roof section with peak cover
42B roof section without cover and radiused
43 column and beam wall and base section
44 interior wall
45 top view of corner of exterior wall
46 wall and roof structural member
46A roof beam structural member
46B column structural member for roof beam
47 expanded polystyrene foam or the like (equal)
48 means to connect structural members (couples of fusing/adhesion process etc)
49 flange for structural members
49A no flange option for structural member
50 chassis or base for Cement-like Coated Mobile Building
51 roof peak
52 window (various sizes)
53 entry door
54 corner
55 sidewall
56 interior door
57 corner seat unit
58 kitchen/dining/living area
59 kitchen seat and table
60 counter
61 bathroom w/fixtures
62 bedroom
continued
63 bed platform
63A larger bed platform
64 closet/storage
65 large bedroom
66 wheel and axis system for Cement-like Coated Mobile Building
67 trailer tongue/connection system
68 cementitious coating like Permacretel™ or equal
69 expanded wire mesh on chassis 50
70 apertures in base 50 for structural members
71 exemplary structural members
71A angle structural member
71B channel structural member
71C W or H structural member
71D I or S structural member
71E Tee structural member
71F modified angle structural member

71G round or circular tube structural member
71H square tube structural member
71I rectangular tube structural member
72 mesh or reinforcement cloth (fiber glass, nylon, metal, composite material or equal)
73 base plate
74 channel or means to locate interior walls
75 radiused interior
76 solid peak (preferred)
77 peak cap or cover means
78 radiused top peak
79 process station
79A Station Zero (0)—Pre-construction
79B Station One (1)—Weld structure
79C Station Two (2)—Interior Walls
79D Station Three (3)—Exterior walls, windows, and roof
79E Station Four (4)—Spray cementitious coating—inside and out
79F Station Five and Six (5 and 6)—Dry/cure
79G Station Seven (7)—Fixtures and Doors
80 process steps
81 process materials
82 stepped fittings of EPS sheets 47
83 pre-sprayed floor panel

DETAILED DESCRIPTION OF PREFERRED EMBODIMENT

The present device is a mechanism for constructing a very durable mobile home and other buildings called a Special Cement-like Coated Mobile Building 31. The preferred embodiment of the device is essentially comprised of a base or chassis 50, an expanded poly styrene foam 47, structural members 46 (of various materials and shapes) inside the foam and a cement based material 68 sprayed on the exterior of the foam (and then finished with a trowel, brush, or other means). The configuration is such that the walls, floor, and roof are rigidly attached to each other yet maintain good flexural strength to resist wind loads and temperature changes. The materials are easily processed to provide many other optional features within the normal course of constructing a mobile home and other buildings. A person having ordinary skill in the field of manufactured housing and general construction appreciates the various means that may be used to physically permit this Special Cement-like Coated Mobile Building 31 to be produced and utilized.

The improvement over the existing art is providing a device that:

a. is very durable.
b. may be re-used for other disaster relief.
c. resists shocks, fire, wind, and other natural or un-natural calamities.
d. is less expensive.
e. is lighter when finished and
f. is less expensive to transport.

There is shown in FIGS. 1-13 a complete operative embodiment of the Special Cement-like Coated Mobile Building device 31. In the drawings and illustrations, one notes well that the FIGS. 1-13 demonstrate the general configuration and use of this invention. The preferred embodiment of the device is comprised of only a few parts as shown in the drawings. These structural members or parts are comprised of and include, but are not limited to, a base or chassis, an expanded poly styrene foam, structural members (of various materials and shapes) inside the foam and a cement based material sprayed on the exterior of the foam. The configuration is such that the walls, floor, and roof are rigidly attached to each other yet maintain good flexural strength to resist wind loads and temperature changes. The materials are easily processed to provide many other optional features within the normal course of constructing a mobile home and other buildings. Various important features of these member components are delineated in FIGS. 1-13 of the drawings and are described below in appropriate detail for one skilled in the art to appreciate their importance and functionality to the Special Cement-like Coated Mobile Building device 31.

The accompanying drawings, which are incorporated in and constitute a part of this specification, illustrate an embodiment of the Special Cement-like Coated Mobile Building device 31 that is preferred. The drawings together with the summary description given above and a detailed description given below serve to explain the principles of the Special Cement-like Coated Mobile Building device 31. It is understood, however, that the Special Cement-like Coated Mobile Building device 31 is not limited to only the precise arrangements and instrumentalities shown.

FIG. 1 is a depiction of the general device. FIG. 1A is a sketch of the general wall section 32. Here the various members to build a typical wall are shown. These are described below. FIG. 1B is a drawing of the model 31 of the Special Cement-like Coated Mobile Building. This model serves as a tool to further describe the components and features in the descriptions below. Next is FIG. 1C is a layout 33 of the floor plan for a Cement-like Coated Mobile Building 31.

Figures 2, 2A, 2B, 2C:
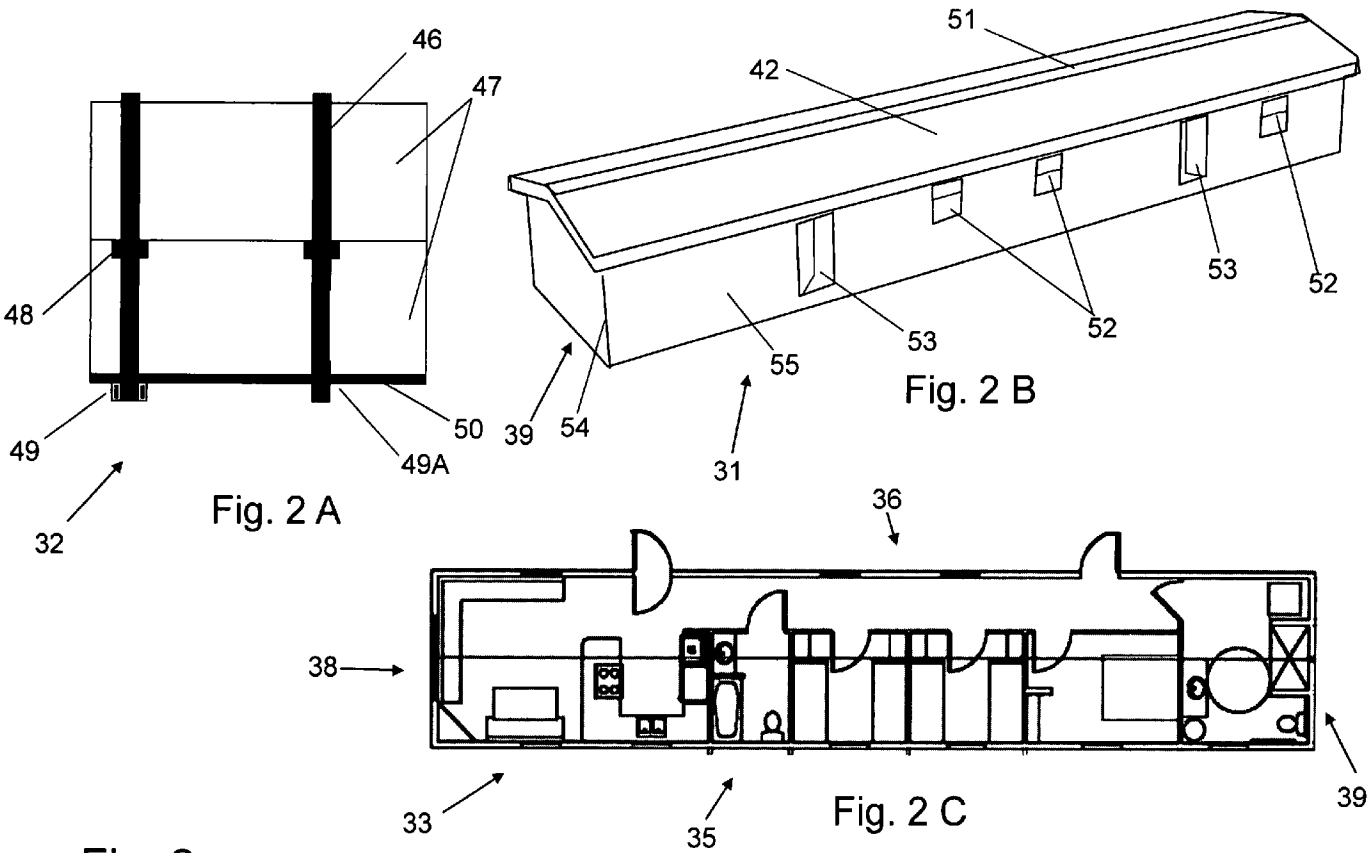
FIGS. 2A through 2C are the same general device with components identified and depicted.

FIGS. 2A through 2C are the same general sketches and drawings of the device with components identified and depicted. FIG. 2A is a sketch of the general wall section 32. Here the expanded polystyrene foam (EPS) 47 sections are shown as part of the main structural base for a wall section 32. This section may be various widths. The preferred size is two layers, 3 inches thick to provide a total of six inches of foam with an outstanding "R" factor for insulation for heating and cooling. One skilled in the art of wall systems well appreciates that the foam might be of other equal propertied materials and may, as technology advances, embrace new composite materials not yet released or even developed for the building trades. However, these other foams and materials are well within the spirit and scope of components for this device known as the Special Cement-like Coated Mobile Building 31.

Within the wall section 32 are structural members 46. These members 46, like reinforcing steel bars for reinforced concrete, serve to strengthen the whole wall system 32. Anticipated for the structural members 46 are various materials including, but not limited to, plastic (PVC, BUTYRATE, STYRENE, ACRYLIC, COPOLYESTER, and the like), metal (steel, aluminum, brass, etc), and other composite materials of equal or greater strength. The structural members 46 will be connected to other members by means of a connector or fusing process 48. Here a typical connector/adaptor may be used to join members 46 or a fusing/connecting process such as adhesion, welding, brazing and the like. Various members to build a typical wall are shown. These are described below. The exterior vertical wall members 32 are connected directly to the chassis or base 50 through apertures 70 (openings) in the chassis 50. These structural members 46 are held to the chassis 50 by means of a press fit, an adhesive (not shown), or a flange 49. Anticipated by this concept are some adhesion or fusion means that require no flanges 49A. Finally, the actual width and length, as well as the thickness, of the EPS may vary for different requirements per engineering and architectural plans.

In FIG. 2B is a drawing of the model 31 of the Special Cement-like Coated Mobile Building. This model serves as a tool to further describe the components and features in the descriptions below. Here several components are depicted including the roof section 42, the roof peak 51, the sidewall 55, and the corners 54. Additionally, the entry door 53 and windows 52 are depicted. These features are anticipated as part of the normal features required for mobile homes and other buildings that use the new cement coated foam building system. Next is FIG. 2C. This is a layout 33 of the floor plan for a Cement-like Coated Mobile Building 31. Shown are the front 36, the rear 35, the kitchen end 38 and the opposite of the kitchen end 39.

Figure 3:
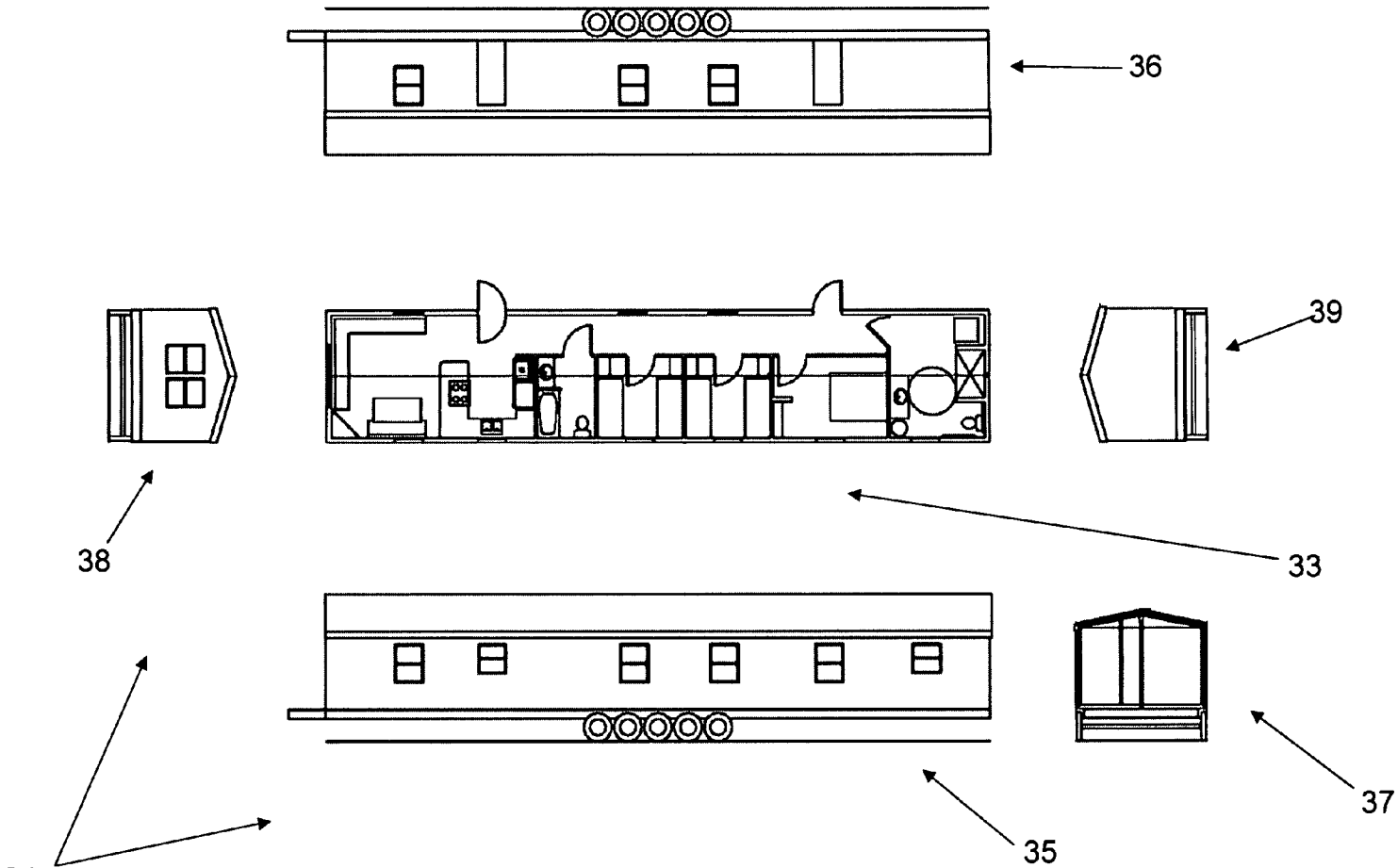
FIG. 3 is the general architectural drawings of the floor plan, elevations, end views and section of the Cement-like Coated Mobile Building.

FIG. 3 is the general architectural drawings 34 of the floor plan 33, elevations 35 and 36, end views 38 and 39, and section 37 of the Cement-like Coated Mobile Building 31. These are each discussed in detail in the paragraphs below.

Figure 4:
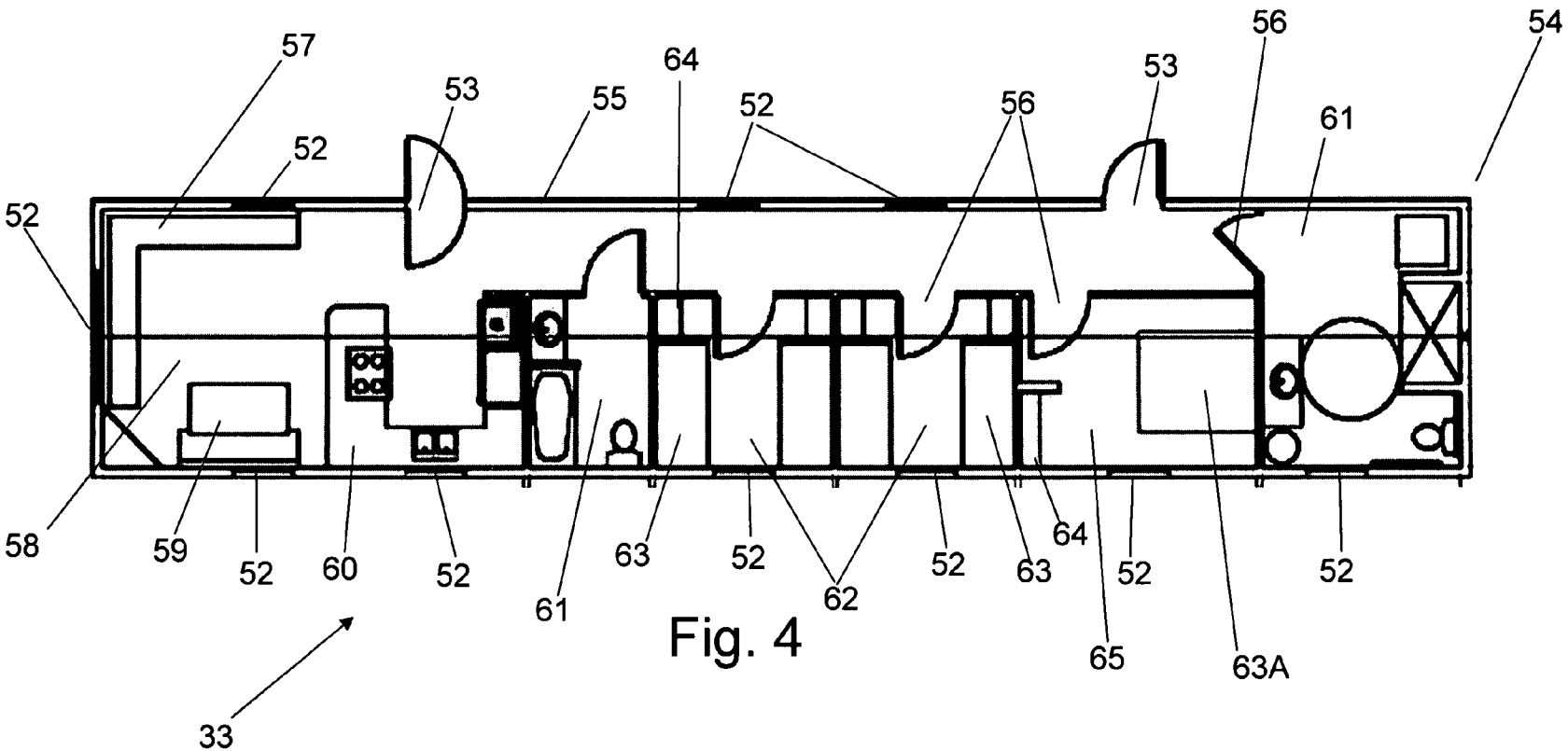
FIG. 4 is a floor plan with many of the components that comprise the Cement-like Coated Mobile Building identified.

FIG. 4 is a floor plan 33 with many of the components that comprise the Cement-like Coated Mobile Building 31 identified. One skilled in the art of mobile home and building floor plans realizes and appreciates the plethora of plans that a builder might provide. These various options and sizes are anticipated and fall within the scope and spirit of this building device and method or process to construct. Here, many of the features and options for the Special Cement-like Coated Mobile Building 31 are demonstrated. The windows 52 are shown in various locations. These may be of any size specified and fit easily into the foam/cement wall of the Special Cement-like Coated Mobile Building 31. Likewise the entry doors 53 may vary in location, quantity and size. Next, the exterior wall 55 and corner 54 are shown. The interior walls 44 and interior doors 56 are also demonstrated. Again, this layout has infinite combinations and permutations, yet is still anticipated in the scope and spirit of the concept behind the Special Cement-like Coated Mobile Building 31.

Other features of this layout 33 include the depictions of the various rooms. Included are the kitchen/living area 58, the bathrooms 61, the bedrooms 62 and the large or master bed room 65. Built in features in these various rooms include the structures for the corner bench 57, the seat and kitchen table 59, the counters 60, bed platforms 63 and 63A and closets and storage means 64. All of these features mentioned are placed prior to spraying the cement-like material 68. This provides these features with a very tough and durable finish. After spraying the material 68, the surface may be troweled, brushed and even coated with other materials to provide the desired finish to the surface. This is discussed further in the description of FIG. 8, below. One skilled in building and layouts appreciates these are examples and not limitations to the Special Cement-like Coated Mobile Building 31.

FIGS. 5A and B are elevations of the Cement-like Coated Mobile Building device 31 with features noted. In FIG. 5A, the rear side elevation is shown. Here the windows 52, the ends 38 and 39, the wheel and axle system 66, the side walls 55, the roof section 42 and the peak 51 are demonstrated. These are all described in detail in the section drawings, below. In FIG. 5B, the Front elevation, these same features are shown as well as the entry doors 53.

FIGS. 6A through 6C are the End views (FIG. 6B and 6C) and a section view (FIG. 6A) of the Cement-like Coated Mobile Building 31 with additional components identified. The trailer tongue or kitchen elevation 38 is shown in FIG. 6B. This sketch shows the end windows 52, the roof section 42, the peak 51 and the wheel and axles 66. Similarly, the opposite end to the kitchen 39 is shown in FIG. 6C.

In FIG. 6A, a cross section of the trailer is shown. Here several important and significant components and features are demonstrated. The wheel and axle system 66 supports the chassis or base 50. In turn, the pre-sprayed floor panel 83 is placed onto the expanded wire mesh 69 that has been rigidly attached (by a connection means such as welding or fastening) to the chassis 50. In turn the exterior walls 55, the vertical columns 46B and the interior walls 44 are placed onto the chassis 50 or mesh 69 and floor panels 83. One notes that the structural members 46 run within the EPS foam 47. In turn the roof 42 is supported by the columns 46B and ridge beam 46A FIG. 7 is a top view 40 of the base or chassis 50 upon which the Cement-like Coated Mobile Building 31 is built. Onto the chassis 50 or base is a wire mesh of expanded metal 69. Likewise, the chassis 50 have specific apertures 70 to receive the structural members 46 (not shown) that run interior to and reinforce the exterior walls 55. Specific apertures 70 are designed to receive structural members 46 and then secured to one another by press fit, fusion, welding, adhesive or other fastening means.

FIGS. 8A through 8C are the wall sections with components identified. In FIG. 8A, a sidewall 32 is shown which is identical to the view shown in FIG. 2A, above. It is repeated here for easy reference to the other figures shown here. The description of FIG. 2A is incorporated here by reference. FIG. 8B is a cross section 41 of a typical wall section. The structural members 46 are centrally located between two sections of EPS 47. The members 46 are glued or connected to the EPS 47 by an adhesive or equal. The location for the members 46 is pre-located in the EPS 47 by a pre-process means such as hot wire cutting, molding, or heat melting the cavity or recess into each half of the wall sections 47 of the EPS material. The member 46 is then placed between the EPS 47 as the assembly is made. Note the connection means 48 between horizontal EPS panels.

After the wall is erected, the surface of the EPS 47 is sprayed with a cement-like material 68 such as Permacrete™ or the like. An alternative means for the external coating is to pre-spray the surface of the EPS 47, then embed a mesh 72, and then final spray the cement-like material 68. In all cases, after the coating 68 is applied, the surface is then troweled or brushed. For some surfaces, a patterned array or template may be used to give a common style and color to the surface. Finally, in some instances, such as for counter tops, an acrylic finish may be incorporated to provide FDA approved food grade finishes. The cement coating 68 as a one-step, pre-spray or final spray is a resilient, cementitious material that has strong flexural strength and rapid curing.

One such example of a suitable cementitious material (offered as an example but not as a limitation) is known as Permacrete™. Further exemplary data about a suitable example of a cementitious material such as Permacrete™ (or the like) includes a three-part, acrylic polymer cementitious resurfacing system of over 6000 PSI compressive strength that provides an architectural, load-bearing surface. The surface is sealed and non-porous, resists chemicals and withstands freeze-thaw cycles as well as intense heat and ultraviolet sun rays. The coating material can easily be applied over such existing surfaces as concrete, aggregate, masonry, steel, asphalt, or foam. The mix includes A matrix mix of high early-strength concrete compounds and specially blended additives; a chemical bonding additive; and acrylic resin sealer (water based) application(s). The material may have color and texture built into the mixture. It is normally sprayed or troweled onto the accepting base surface and then lightly troweled to finish the surface. The application results in an outstanding, durable and attractive surface which is amazingly easy to maintain with normal household detergents. Safety considerations are enhanced by the increased slip resistance of the materials for the floor surfaces.

Example architectural specifications for an exemplary (but not limiting) cementitious coating is shown in TABLE A.

TABLE A

ARCHETECTURAL SPECIFICATIONS FOR AN EXAMPLE COATING
Architectural Specifications for the Permacrete ™ example

| Test | Method | Results |
|---|---|---|
| Compressive Strength | ASTM C-109 | 5690 PSI* |
| Flexural Strength | ASTM C-348 | 1835 PSI |
| Tensile Strength | ASTM C-190 | 855 PSI |
| Shear Bond Adhesion | ASTM C-882 | >550 PSI |
| Impact Strength | LAB METHOD | 22 in./lb. |
| Abrasion Resistance | ASTM C-944 | 1.57% Wt. Loss |
| Slip Resistance | ASTM D-2047 | 0.74 Wet |
| Slip Resistance | ASTM D-2047 | 0.78 Dry |
| Water Absorption | ASTM C-642 | 6.5% (72 Hrs.) |
| Weight (Cured) | ⅛" Typical Thickness | 1.12 lbs./ft. |
| Freeze-Thaw | ASTM C-666 | <0.5% Wt. Loss |
| Accelerated Weathering | ASTM G-23 | Unaffected (4000 Hrs.) |
| Chemical Resistance | ASTM D-2299 | Unaffected |
| Fire Resistance | ASTM E-108 | Class A |
| Fire Resistance | UBC 32-7 | Class A |
| Flame Spread | ASTM E-84 | Exceeds Std. |
| Fire Resistance | ASTM E-119 | Passed @ 1 Hour |
| Wind Uplift | FM I-52 | Exceeds Std. |
| Moisture Resistance | ASTM D2247 | Unaffected @ 6 Wks |
| Mildew Resistance | ASTM G-21 | Class A |
| Mildew Resistance | Mil 810-B | No Growth @ 6 Wks |
| Wind Driven Rain | TTC-555B | No Penetration |
| Shrinkage | ASTM C-596 | Exceeds Std. |

Other materials are available that may, (by simple empirical test for strength, flexibility, moisture resistance, and other engineering characteristics)prove suitable. Anticipated in the scope and spirit of materials to accomplish this Special Cement-like Coated Mobile Building 31 are other composite materials that will equal or exceed the properties of Permacrete™. Use of the mesh 72 is the preferred process for this Special Cement-like Coated Mobile Building 31. The mesh 72 is a cloth or mesh "fabric" made of Fiber Glass. Alternatives of other composite materials, metal screens, nylon mesh, and other cloths may be equally suited and anticipated in the scope of this device with appropriate empirical testing. However, natural materials, subject to decay or rot are not recommended for this embodiment.

In FIG. 8C, several structural members 46 are shown and denoted as various members 71. Here, the internal structural members 46 are not limited to a specific material or structural shape. One skilled in the art of structural members realizes and appreciates various plastics (PVC, BUTYRATE, STYRENE, ACRYLIC, COPOLYESTER, and the like), steels, other metals, and other composite materials may fully support the scope of some of the components for the Special Cement-like Coated Mobile Building 31. The various shapes are shown in the FIG. 8C and the following Table B.

TABLE B

EXAMPLES OF Structural Members

| N0. | ITEM |
|---|---|
| 1 | Square/Rectangular Tubing 71I and H |
| 2 | Round or elliptical tubing 71 G |
| 3 | I or S beam/columns 71 D |
| 4 | Single or plurality of "C" channels 71B |
| 5 | Single or a plurality of equal or unequal legged angle structures 71A |

TABLE B-continued

EXAMPLES OF Structural Members

| N0. | ITEM |
|---|---|
| 6 | "X" structures and modified angles 71 F |
| 7 | H or W beam/columns 71 C |
| 8 | Tee bars 71 E |
| 9 | Wye - "Y" bars - not shown |

FIGS. 9A through 9C are some examples of roof peak optional embodiments for the Cement-like Coated Mobile Building 31. FIG. 9A is the preferred embodiment of a peak 76 without any cover or cap. The support means of the columns and beams are described in FIG. 10A, below. Here, the empirical tests show that the cement coating 68 such as Permacrete™ or the like provides adequate expansion and contraction adaptability to remove any need for a cap or cover. As an alternative to applying just the cementitious materials 68, an alternative moisture prevention sealant may be applied to the roof and/or exterior sidewalls. Further, in FIG. 9B, an alternative embodiment shows a roof cap 77 being placed along the ridge of the roof. While not expected to be required, this alternative embodiment may have some usefulness for large buildings or the plethora of other floor plans than those exemplified in the present descriptions. In FIG. 9C, another embodiment 42B showing a radiused peak 78 is shown. This configuration may relieve the stresses commonly present with abrupt angular connections.

FIGS. 10A through 10F are depictions of wall elevations and sections that show various components of the Cement-like Coated Mobile Building 31. In FIG. 10A, the typical column and beam cross section 43 is shown. Here the column 46B rests on the floor section on a base plate 73. The ridge beam 46A is securely affixed and fastened at the top of the column 46B. This beam 46A in turn supports the roof section comprised of the EPS 47, the structural members 46, the mesh 72 and the cement-like coating 68. Note well the EPS foam 47 is a two piece assembly as an example and not a limitation. The roof section is similarly configured as the wall sections described above. One also notes that the base plate 73 rests on the pre-sprayed floor 83 and ultimately on the mesh 69 and chassis 50 of the Special Cement-like Coated Mobile Building 31.

In FIG. 10B, a typical interior wall 44 is shown. Here, the walls are constructed similarly to the exterior and column walls. The EPS foam 47 is vertical and rests inside of a channel or set of angle structures 74 to locate the interior wall 44. The wall 44 rests on top of the floor system comprised of the wire mesh 64, the foam 47, the mesh 72, and the coating 68. The interior walls 44 may or may not have the structural members 46. FIG. 10C show an alternative corner system. One skilled in the art appreciates that most wall intersections result in a 90 degree corner inside and out. This is one anticipated configuration. As an alternative embodiment, FIG. 10C demonstrates a radiused interior 75 with a foam filled plenum 47 and an augmented angular structural member 71F. With the spray on cementitious coating 68, this radius may provide stress reduction to the corner members 54 of the Special Cement-like Coated Mobile Building 31.

In FIGS. 10D, 10E and 10F, various configurations at key junctions 82 for walls, roofs and floors are shown. These configurations are provided as examples and not limitations to the many different step manners 82 to configure the joints. These intersections demonstrate that the walls, roofs and floors may well be configured in various ways and still be well within the scope and spirit of the Special Cement-like Coated Mobile Building 31.

FIGS. 11A through 11C are drawings of the model Cement-like Coated Mobile Building from various angles. This model, from various views, shows the Special Cement-like Coated Mobile Building 31 and a front entry view 38 and rear view of the Special Cement-like Coated Mobile Building 31.

FIGS. 12A through 12C are additional drawings of the model Cement-like Coated Mobile Building 31 with the roof section removed. These drawings permit many of the various components for the Cement-like Coated Mobile Building 31 to be demonstrated. Similarly to the floor plans depicted above in FIG. 4, the various features and components are delineated in these drawings.

All of the details mentioned here are exemplary and not limiting. Other specific components specific to describing a Special Cementlike Coated Mobile Building and Process to Manufacture 31 may be added as a person having ordinary skill in the field of building devices and methods to manufacture such devices well appreciates.

Operation of the Preferred Embodiment

The new Special Cement-like Coated Mobile Building device 31 has been described in the above embodiment. Once built, the Special Cement-like Coated Mobile Building device 31 is transported to an area of need, connected to utilities, and is ready for immediate occupancy by persons in need of shelter. The manner of how the device is built is repeated below. One notes well that the description above and the operation described here must be taken together to fully illustrate the concept of the Special Cement-like Coated Mobile Building device 31.

The preferred embodiment described above is essentially comprised of only a few parts as shown in the drawings. This preferred embodiment is comprised of and includes, but is not limited to, a base or chassis 50, an expanded poly styrene foam 47, structural members 46 (of various materials and shapes) inside the foam and a cement based material 68 sprayed on the exterior of the foam. The configuration is such that the walls, floor, and roof are rigidly attached to each other yet maintain good flexural strength to resist wind loads and temperature changes. The materials are easily processed to provide many other optional features within the normal course of constructing a mobile home and other buildings.

The uses for the mobile home and other devices are many. This same type of Special Cement-like Coated Building 31 could easily be adapted for other uses. The following TABLE C shows some examples and not limitations of this building concept.

TABLE C

EXAMPLES OF USES

| N0. | ITEM | COMMENT |
|---|---|---|
| 1 | Mobile Home | Movable and set on foundation or fixed jacks - various sizes |
| 2 | Disaster relief shelter | On Wheels or Alt. build directly to base |
| 3 | Temporary Classrooms | On Wheels or Alt. build directly to base |
| 4 | Temporary Offices | On Wheels or Alt. build directly to base |
| 5 | College Housing | On Wheels or Alt. build directly to base |
| 6 | Low Cost housing | Single units or apartment multiple units |
| 7 | Entry or Check point Buildings | Guard shacks, entry points, other - On Wheels or Alt. build directly to base |
| 8 | Light Commercial Buildings | Build directly to base |
| 9 | Simple/Fast Storage units | Build directly to base |
| 10 | Food Preparation Units | On Wheels or Alt. build directly to base |
| 11 | Apartment Modules | Build directly to base or overall building structure |
| 12 | Military Barracks | On Wheels or Alt. build directly to base |
| 13 | Fast containment housing for prisons and detention areas | On Wheels or Alt. build directly to base |

The inherent process to build these mobile homes and other buildings have been described above and shown in the accompanying drawings. The process is also listed in detail in Table D.

FIG. 13 shows the various stations in the process to build the Cement-like Coated Mobile Building 31. Each station 79 has a series of processes 80 which are applied with the presence or addition of specific materials 81 as described below in TABLE D. TABLE D is a summary of the process 79 used to build the Cement-like Coated Mobile Building 31. Here the various stations are shown which portray an exemplary process to build the Special Cement-like Coated Mobile Building 31. One well versed in manufacturing processes appreciates that the actual steps of the process may vary somewhat and still be within the scope and spirit of the process to build the Special Cement-like Coated Mobile Building 31.

TABLE D

Process and Stations

| Step | Station (FIG.) | Process | Materials |
|---|---|---|---|
| 0 | FIG. 13-0 Pre-construction 79A | Prep Chassis and place onto Build Conveyor<br>Place on Dolly | |
| 1 | FIG. 13-1 Weld - 79B | 1. Weld Wire Mesh<br>2. Weld Columns On To Frame<br>3. Place 3" Foam Expanded Poly Styrene | Steel Columns<br>Steel Beams<br>Permacrete ™<br>3" Foam |

TABLE D-continued

| Step | Station (FIG.) | Process | Materials |
|---|---|---|---|
| | | Process and Stations | |
| | | 4. Place Pre-sprayed Floor panels<br>5. Mark Wall Locations<br>6. Weld Ridge Beam (W6 × 20) | |
| 2 | FIG. 13-2<br>Interior - 79C | 1. Install All Interior Walls<br>2. Install Beds, Counters, Benches, Etc. | Purchased Foam Pre-Cut To Size<br>Adhesive |
| 3 | FIG. 13-3<br>Exterior - 79D | 1. Pre-Wire Pipes<br>2. Pre-Build Roof<br>1. Install Interior Section Of Exterior Walls<br>2. Install Plumbing & Wiring<br>3. Cover Outlets, Etc.<br>4. Install Exterior Section Of Exterior Walls<br>5. Install Roof | Purchased Foam Pre-Cut To Size<br>Piping<br>Wiring<br>PVC (or the like) |
| 4 | FIG. 13-4<br>Spray 79E | 1. Spray With Cementitious Mixture (Permacrete ™ or equal)<br>1A. Pre-Spray/Wrap with F/G mesh or equal/Final Spray | Concrete Mixture<br>Fiberglas mesh or equal |
| 5&6 | FIG. 13-5 & 6<br>Dry 79F | 1. Dry For 1 Hour In Each Station | |
| 7 | FIG. 13-7<br>Fixtures and Doors 79G | 1. Install All Windows<br>2. Install All Sinks, Bathtub/Showers, & Toilets<br>3. Install Bathroom And Closet Fixtures<br>4. Install Appliances<br>5. Install Doors | Windows<br>Sinks<br>Bathtubs/Showers<br>Toilets<br>Bathroom & Closet Fixtures<br>Appliances Doors<br>Hot Water Heater<br>Electric Baseboard Heaters<br>Outlets & Switches |
| Post | Post Construction | Exit Build Conveyor Dolly | |

With this description it is to be understood that the Special Cement-like Coated Mobile Building 31 and Process to Manufacture is not to be limited to only the disclosed embodiment. The features of the Special Cement-like Coated Mobile Building 31 and Process to Manufacture are intended to cover various modifications and equivalent arrangements included within the spirit and scope of the description.

What is claimed as new and desired to be protected by Letters Patent is:

1. A special durable and rugged building device comprising:

(a) a base assembly comprising a movable chassis and a wheel and axle assembly, the chassis having a wire mesh covering the area bounded by the chassis, one or more layers of semi-rigid foam panels on top of and covering the same area as the wire mesh, a cementitious material coating applied to the wire mesh and a bottom side of the one or more layers of semi-rigid foam panels, and a cementitious material coating applied to a top surface of the one or more layers of semi-rigid foam panels;

(b) a plurality of essentially vertical wall structural members, each having an upper end and lower end;

(c) a means to securely attach the lower end of the essentially vertical wall structural members to the chassis;

(d) a plurality of roof structural members;

(e) a means to connect the roof structural members to other roof and wall structural members;

(f) a plurality of pairs of a semi-rigid foam panels, said vertical wall structural members embedded between said pairs of semi-rigid foam panels;

(g) a means to attach the pairs of semi-rigid foam panels to each other and to the vertical wall structural members; and (h) a cementitious material coating continuously and completely adhering to the exterior surfaces of the semi-rigid foam panels whereby the device provides a secure floor, wall, and roof building.

2. The building device according to claim 1 wherein the means to securely attach the vertical wall structural members to the chassis is by extending the lower end of the vertical wall structural member through an aperture in the chassis, the aperture of the chassis and the vertical wall structural member configured to result in a press fit between the member and the chassis.

3. The building device according to claim 2 wherein the chassis has a lower plane and the vertical wall structural member extends through the aperture of the chassis and beyond the lower plane and whereby a collar is attached to the extended vertical wall structural member and secures the vertical wall structural member to the lower plane of the chassis.

4. The building device according to claim 1 wherein the semi-rigid foam is an expanded polystyrene foam.

5. The building device according to claim 1 wherein the means to attach the pairs of semi-rigid foam panels to each other and to the structural members is by an adhesive.

6. The building device according to claim 1 wherein the means to attach the pairs of semi-rigid foam panels to each other and to the structural members is by a heating process.

7. The building device according to claim 6 wherein the heating process is by means of a friction weld between the adjacent semi-rigid foam panels and vertical wall structural members.

8. The building device according to claim 1 wherein the cementitious material coating is a mix comprised of high early-strength concrete compounds, specially blended additives, a chemical bonding additive, and acrylic resin sealers.

9. The building device according to claim 8 wherein the cementitious material has a mesh material embedded within to provide a reinforcing and strengthening means to the coating.

10. The building device according to claim 1 wherein the structural members are round tubes.

11. The building device according to claim 1 wherein the structural members are square tubes.

12. The building device according to claim 1 wherein the vertical wall structural members are I-beams.

* * * * *